United States Patent [19]

Olson

[11] 4,262,597

[45] Apr. 21, 1981

[54] PRE-WRAPPED TWO-PIECE RING AIRFOIL PROJECTILE OF NON-HAZARDOUS MATERIAL

[75] Inventor: Donald N. Olson, Lutherville, Md.

[73] Assignee: The United States of America as represented by the Secretary of the Army, Washington, D.C.

[21] Appl. No.: 6,326

[22] Filed: Jan. 25, 1979

[51] Int. Cl.[3] ..... F42B 11/100

[52] U.S. Cl. ..... 102/92.6; 102/DIG. 10

[58] Field of Search ..... 102/91, 92.1–92.7, 102/DIG. 10

[56] References Cited

U.S. PATENT DOCUMENTS

| | | | |
|---|---|---|---|
| 636,485 | 11/1899 | Brown | 102/DIG. 10 |
| 1,327,531 | 1/1920 | Durham | 102/DIG. 10 |
| 3,898,932 | 8/1975 | Flatau | 102/DIG. 10 |
| 3,980,023 | 9/1976 | Misevich | 102/DIG. 10 |

*Primary Examiner*—Harold J. Tudor

*Attorney, Agent, or Firm*—Nathan Edelberg; Robert P. Gibson; A. Victor Erkkila

[57] ABSTRACT

The invention is a non-lethal projectile for use in riot control. The structure is an improvement over prior similar projectiles, in that the sealing of the riot control agent payload is enhanced, thereby preventing leakage and consequent rejection. The invention allows for the complete sealing of the payload cavity, before filling, and then the introduction of the payload by a hypodermic type needle to penetrate the sturdier rubber-like final closure cover which self-seals when the needle is withdrawn.

9 Claims, 3 Drawing Figures

PRE-WRAPPED TWO-PIECE RING AIRFOIL PROJECTILE OF NON-HAZARDOUS MATERIAL

BACKGROUND AND SUMMARY OF THE INVENTIOn

The invention described herein may be manufactured, used and licensed by or for the Government for Governmental purposes without the payment to me of any royalties thereon.

The invention relates to projectiles, and in particular to ring airfoil projectiles for riot control.

A need has existed for a fabricated ring airfoil projectile that will withstand flexing, stretching, compressing, and otherwise deforming during the manufacturing process, and not be subject to the frequent leakage, and consequent high rejection rate, as generally experienced in the present projectiles. This invention provides a projectile to overcome these problems.

In the prior art a non-lethal projectile has been invented (U.S. Pat. Nos. 3,951,070 and 3,898,932) for use in quelling civil disturbances by delivering a riot control agent to individual rioters. The projectile is launched from a launching device, for which a separate patent application has been submitted and in which the inventor of this projectile is a co-inventor.

In the existing technology of manufacturing non-lethal projectiles, certain problems have been apparent as hereinbefore mentioned. This invention improves the sealing of the riot control agent payload in the projectile as the means to overcome the problems.

In the current method of packaging the payload, a container that is as long as the circumference of the projectile is filled with the payload, sealed, and then wrapped around the outer surface of the projectile body where it fits neatly into an annular recess. Then a paper band is wrapped around the projectile to hold the payload package in place and to serve as the breakband.

The method described requires the formation of a filled and sealed container which is exceedingly fragile, calling for thin gage material which will rupture easily in order for the projectile to function properly at impact. The container also has to be of dissimilar materials; one, a vacuum formable plastics to provide the recessed cavities, with walls, which give the container the necessary volume to contain a useful payload, and the other a covering material which will tear or rupture easily without stretching before failure. These two dissimilar materials have to be bonded to one another.

It is difficult to fill and seal a container constructed in this manner because, in addition to being made deliberately fragile, it is subject to contamination by the payload, making it difficult to bond the materials to one another.

After the package has been sealed, it must be wrapped around the projectile body, thus flexing, stretching, compressing, and otherwise deforming it so that it will conform to the annular cavity in the projectile body.

The process of manufacture and fabrication as described frequently causes leakage, resulting in a high rejection rate. As the payload is often intended to be an unpleasant irritant to the human body, it is necessary to decontaminate rejected packages and any objects which are contaminated by the leakage, thereby adding to the cost of production.

A further difficulty arises from the obvious requirement that the packaging materials be compatiple with the payload which severely restricts the materials which can be employed.

This invention circumvents the problems stated hereinbefore by allowing the fragile structure, required for the proper functioning of the projectile at impact, to be assembled on the projectile and sealed and bonded to it before the payload cavity is filled. Then a sturdier cover can be employed as a final closure, where fragility and rupturability is not required, for final sealing of the payload cavity.

This invention allows for the complete sealing of the payload cavity, before filling, and then the introduction of the payload using a hypodermic type needle to penetrate the sturdier final closure cover, which will be a rubber material, that will seal itself when the needle is withdrawn. Such a procedure would be most appropriate where the payload is a liquid or a gel.

The invention consists of a hollow ring shaped projectile made of soft resilient material which has a low aerodynamic drag, and is so configured to enhance this low aerodynamic drag, is launched spinning, and has a relatively flat trajectory. It is designed to carry a riot control agent in its hollow portion. The outer wall of the projectile, in the present embodiment, is a layered wall of aluminum covered with paper. The wall is designed to be pre-loaded in flight due to the forces generated by the spin, causing the payload and the resilient projectile body to bear against it. At impact with a target, the wall of the projectile, called a breakband, ruptures and released the riot control agent on, and in the vicinity of the target.

It is, therefore, an object of the invention to provide a ring airfoil projectile that may be completely assembled, sealed, and bonded before the payload cavity is filled.

It is a further object of the invention to provide a ring airfoil projectile wherein the payload can be introduced by use of a hypodermic type needle after being completely assembled, sealed, and bonded.

It is another object of the invention to provide a ring airfoil projectile which has a low aerodynamic drag and is launched spinning.

It is yet another object of this invention to provide a ring airfoil projectile that has a two-piece structure.

It is still another object of this invention to provide a ring airfoil projectile that is pre-wrapped during fabrication and assembly.

Further objects and advantages of the invention will become more apparent in light of the following description of the preferred embodiment.

DESCRIPTION OF THE PREFERRED EMBODIMENT

Figure 1:
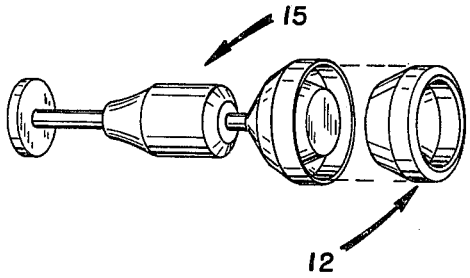
FIG. 1 is a perspective view of the complete ring airfoil projectile, shown exiting from the sabot of the launching device.

Referring now to the drawings, and particularly to FIG. 1 is a pre-wrapped two-piece ring airfoil projectile of now hazardous material is shown at 12. Said projectile is shown exiting from the cup-shaped portion of the sabot 15. Said sabot 15 being the device which holds the said projectile 12, and which is propelled within the mechanism of a launching device to eject said projectile toward a target.

Figure 2:
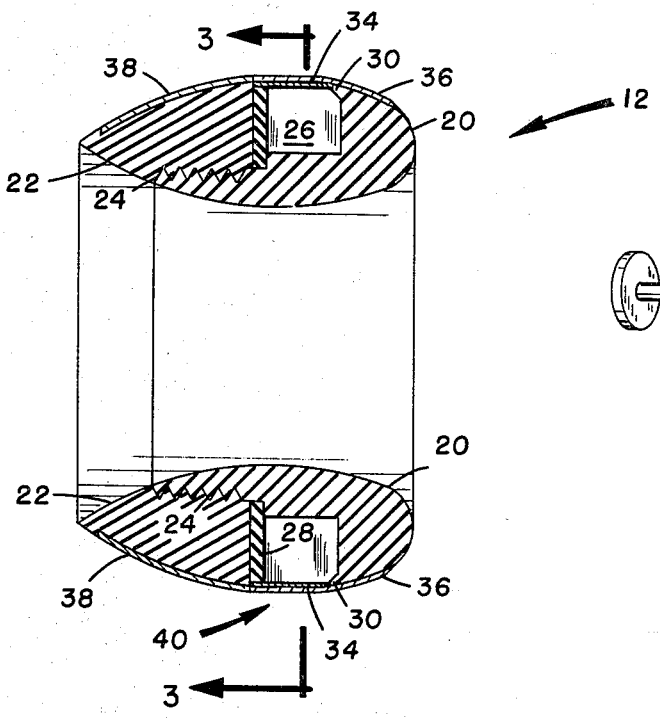
FIG. 2 is a cross sectional view through the ring airfoil projectile.
Figure 3:
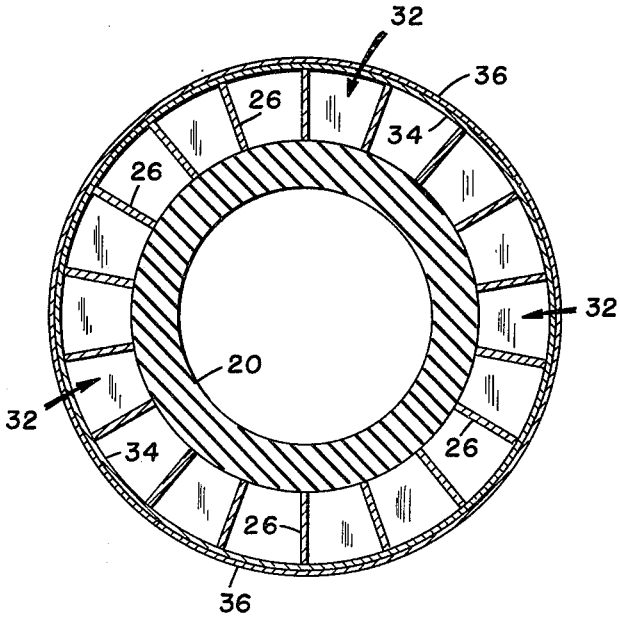
FIG. 3 is a cross sectional view taken on line 3—3 of FIG. 2, showing entire ring airfoil projectile in cross section.

The body structure of the ring airfoil projectile 12 is shown in cross section in FIG. 2 and in a cross section in FIG. 3 across the body structure in a direction prependicular to the cross section in FIG. 2.

The two parts of the ring airfoil projectile 12 can be seen in FIG. 2. The two parts are the forward or leading portion 20 and the aft or trailing portion 22.

The leading portion 20 and the trailing portion 22 are shown attached to each other by a screw thread 24. However the connection can be snap fit without the use of screw threads or the two parts can be cemented together with an adhesive.

The two parts, the leading portion 20 and the trailing portion 22 are made of molded rubber. However, it is to be understood that the two parts may be made of any suitable rubber-like material. The use of such other rubber-like material for these two parts is within the scope and intent of this invention.

The screw thread 24 on the leading portion 20 is an external or male thread, and the screw thread 24 on the trailing portion 22 is an internal or female thread.

A plurality of payload cavities 32 are contained in the leading portion 20. These cavities 32 are established and separated from each other by a plurality of partitions 26. Said partitions 26 extend from the interior section of the body of the leading portion 20 to the periphery of the exterior circumferential surface thereof.

The interior space of the body of the leading portion 20 at the said partitions 26, and extending for the height of said partitions 26 in the other direction, is the annular payload section 40. The total space of the annular payload section 40 being the sum of the volumes of all of the payload cavities 32.

An annular ramp 30, showing within each cavity 32 at the surface of each said cavity 32 nearest the leading edge of said leading portion 20, is located at the periphery of the exterior circumferential surface thereof. Said annular ramp 30 provides a large area at the said exterior circumferential surface, of said leading portion 20, to which a very thin aluminum foil covering 34 is bonded on the leading portion 20.

It is to be understood that the use of metal-like or other materials other than aluminum foil for the covering 34 is within the scope and intent of this invention.

A paper breakband 36 is wrapped around the leading portion 20 over the top of aluminum foil covering 34 and bonded to the aluminum foil covering 34 and to the adjacent surface areas of the leading portion 20.

A circular rubber gasket cover 28 shaped to cover all said cavities 32, is bonded to the leading portion 20 and to the inside surface of the aluminum foil covering 34 as the final closure and seal of the payload section 40. Said final closure covers and seals all of the said payload cavities 32.

The rubber gasket cover 28 may be secured to the payload section 40 either before or after filling the payload cavities 32, depending on the method of filling the cavities 32. However, because of problems, as hereinbefore stated, this invention provides for a structure which permits the filling of the payload cavities 32 with the payload material by a hypodermic needle after the structure of the leading portion 20 is completely assembled. This novel and unique method is the preferred embodiment.

When the hypodermic needle penetrates the rubber gasket cover 28, to fill each cavity, and is withdrawn, the rubber is self closing around the hole where the penetration was made.

It should be understood that the use of any other rubber-like material for the gasket cover 28 is within the scope and intent of this invention.

The trailing portion 22 is covered with a paper or other non-stretchable material covering 38 in a manner similar to the covering of the leading portion 20.

The covered trailing portion 22 is assembled to the leading portion 20 after the payload section 40 has been filled and sealed to complete the pre-wrapped two-piece ring airfoil projectile of non-hazardous material.

As can readily be understood from the foregoing decription of the invention, the present structure can be configured in different modes to provide the functions of a projectile.

Accordingly, modifications and variations to which the invention is susceptible may be practiced without departing from the scope of the appended claims.

What is claimed is:

1. A ring airfoil projectile structure, comprising:

a leading structure including:

a cylindrical-like body means, having a passageway therethrough, and having a plurality of payload cavities therein each separated from each other by a partition, each open at the top and on the exterior side of said body means;

a metal-like covering for the exterior open side of said cavities, said covering bonded to the plurality of said partitions and to said body means;

a paper breakband covering over said metal-like covering and extending over a portion of said body means;

a rubber-like seal bonded to the top of said plurality of payload cavities and to the interior surface of said metal-like covering to completely enclose and seal said payload cavities; and a payload material within each of said plurality of payload cavities; and a trailing structure attached to said leading structure by suitable means.

2. The ring airfoil projectile recited in claim 1, wherein said body means contains a male screw thread on a cylindrical projection from said body means which surrounds said passageway through said body means.

3. The ring airfoil projectile recited in claim 2, wherein said trailing structure consists of:

a cylindrical-like body means, having a passageway therethrough;

a non-stretchable covering bonded to the exterior side of said body means;

a female screw thread on the interior of said passageway through said body means of said trailing structure, said female screw thread mating with said male screw thread on said leading structure to attach said trailing structure to said leading structure to form said ring airfoil projectile structure.

4. The ring airfoil projectile recited in claim 2, wherein the exterior configuration of the end of said body means opposite to side having said male screw thread thereon, is aerodynamically shaped to reduce aerodynamic drag.

5. The ring airfoil projectile recited in claim 1, wherein each said cavity is provided with a portion of an annular ramp surrounding said body means, said ramp being at the edge of each said cavity at the periphery of said cylindrical-like body means and between said partitions of adjacent cavities, said ramp providing a larger area to which said metal-like covering can be bonded.

6. The ring airfoil projectile recited in claim 1, wherein said leading structure and said trailing structure are made of a rubber-like material having a low aerodynamic drag.

7. The ring airfoil projectile recited in claim 1, wherein said trailing structure is attached to said leading structure by a snap fit closure.

8. The ring airfoil projectile recited in claim 1, wherein said trailing structure is attached to said leading structure by an adhesive.

9. A ring airfoil projectile structure comprising:

a leading element consisting of a cylindrical-like body means, having a passageway therethrough, and having a plurality of payload cavities therein each separated from each other by a partition, each said cavity open at the top and on the exterior side of said body means, each said cavity being provided with a portion of an annular ramp surrounding said body means, said ramp being at the edge of each said cavity at the periphery of said cylindrical-like body means and between said partitions of adjacent cavities, said ramp providing a larger area to which a metal-like covering, hereinafter described, can be bonded, exterior configuration of the end of said body means opposite the side having a male screw thread thereon, hereinafter described, being aerodynamically shaped to reduce aerodynamic drag, said body means being made from a rubber-like material having a low aerodynamic drag, a metal-like covering for the exterior open side of said cavities, said covering bonded to the plurality of said partitions and to said body means, a paper breakband covering over said metal-like covering and extending over a portion of said body means, a rubber-like seal bonded to the top of said plurality of cavities and to the interior surface of said metal-like covering to completely enclose and seal said payload cavities, a payload material within each of said plurality of payload cavities, and a male screw thread on a cylindrical projection from said body means which surrounds said passageway through said body means; and a trailing element, consisting of a cylindrical-like body means, having a passageway therethrough, a non-stretchable covering bonded to the exterior side of said body means, a female screw thread on the interior of said passageway through said body means of said trailing structure, said female screw thread mating with said male thread on said leading element to attach said trailing element to said leading element to form said ring airfoil projectile, the shape of said cylindrical-like body means being configured to fit into a cup-type sabot for the purpose of launching said projectile, the configured portion of said body means being that side opposite to said where said female thread begins.

* * * * *